US007866881B2

(12) United States Patent
El Kholy et al.

(10) Patent No.: US 7,866,881 B2
(45) Date of Patent: Jan. 11, 2011

(54) DRY POLYMER HYDRATION APPARATUS AND METHODS OF USE

(75) Inventors: Ismail El Kholy, Sugar Land, TX (US); Gregoire Jacob, Blois (FR); Jean-Louis Pessin, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/797,699

(22) Filed: Jun. 10, 2010

(65) Prior Publication Data

US 2010/0246318 A1 Sep. 30, 2010

Related U.S. Application Data

(62) Division of application No. 11/246,969, filed on Oct. 7, 2005, now Pat. No. 7,794,135.

(60) Provisional application No. 60/625,546, filed on Nov. 5, 2004.

(51) Int. Cl.
*B01F 3/12* (2006.01)

(52) U.S. Cl. ..... 366/348; 366/163.2; 366/165.4

(58) Field of Classification Search ... 366/165.1–165.5, 366/167.1, 173.1–173.2, 141, 163.2, 348–349; 137/888–896

See application file for complete search history.

(56) References Cited

U.S. PATENT DOCUMENTS

| | | | |
|---|---|---|---|
| 1,842,877 | A | 1/1932 | Muller et al. |
| 3,047,275 | A | 7/1962 | Cox |
| 3,542,342 | A | 11/1970 | Barron |
| 3,819,157 | A | 6/1974 | Markfelt |
| 3,881,656 | A | 5/1975 | Markfelt et al. |
| 3,994,480 | A | 11/1976 | Fothergill et al. |
| 4,092,013 | A | 5/1978 | Staaf |
| 4,100,614 | A | 7/1978 | Mandt |
| 4,498,819 | A | 2/1985 | El-Saie et al. |
| 4,643,582 | A | 2/1987 | Ricciardi |

(Continued)

FOREIGN PATENT DOCUMENTS

| | | |
|---|---|---|
| EP | 0050312 | 4/1982 |

(Continued)

*Primary Examiner*—Charles E Cooley
(74) *Attorney, Agent, or Firm*—Michael Dae; David Cate; Robin Nava

(57) ABSTRACT

Disclosed are apparatus and methods for preparing wellbore viscous treatment gels from dry polymer and water. The apparatus includes an eductor which slurries dry polymer with water, at least two input tubes, wherein one input tube is connected with the eductor, and another to a water source. The apparatus also includes a mixing chimney connected to the input tubes. The mixing chimney includes a lower input section with inlets connected to the input tubes wherein a jet of metered dilution water is applied at high pressure to the incoming polymer-water slurry stream. This mixture is then accelerated in a circular, and preferably upward, motion where it is sheared against the wall of a central section of the chimney, without the use of an impeller. The chimney further includes an output section that comprising holes circumferentially located, through which the mixture passes from the central section and into a hydration tank. The mixture exiting the chimney is polymer-water gel which is essentially fully mixed and de-aerated, and at least partially hydrated.

6 Claims, 3 Drawing Sheets

U.S. PATENT DOCUMENTS 4,688,945 A 8/1987 Brazelton et al.
4,726,686 A 2/1988 Wolf et al.
4,738,540 A 4/1988 Banks
4,749,336 A 6/1988 Rojey
4,828,034 A 5/1989 Constien et al.
4,863,277 A 9/1989 Neal et al.
4,915,505 A 4/1990 Arribau et al.
5,046,856 A * 9/1991 McIntire ..... 366/291
5,190,374 A 3/1993 Harms et al.
5,222,807 A 6/1993 Gaddis
5,344,619 A 9/1994 Larwick et al.
5,382,411 A 1/1995 Allen
5,388,905 A 2/1995 Ake et al.
5,426,137 A 6/1995 Allen
5,580,168 A 12/1996 Alireza et al.
5,705,060 A 1/1998 Robberts
5,857,773 A 1/1999 Tammelin
5,947,596 A 9/1999 Dowd
6,234,258 B1 5/2001 Karigan
6,357,906 B1 3/2002 Baudoin et al.
6,537,450 B2 3/2003 Russell et al.
6,796,704 B1 9/2004 Lott
7,018,435 B1 3/2006 Wentinck
7,575,364 B2 8/2009 Goto et al.
7,581,872 B2 9/2009 Allen
7,794,135 B2 * 9/2010 El Kholy et al. ..... 366/163.2
2003/0081493 A1 5/2003 Allen
2004/0218463 A1 * 11/2004 Allen ..... 366/164.6
2004/0256106 A1 12/2004 Phillippi et al.
2005/0111298 A1 5/2005 Lott
2006/0107998 A1 5/2006 Kholy et al.
2008/0037364 A1 2/2008 Dietrich et al.
2010/0246318 A1 * 9/2010 Kholy et al. ..... 366/152.1

FOREIGN PATENT DOCUMENTS

JP 2000024476 1/2000
WO 2006/048811 A1 * 5/2006

* cited by examiner

DRY POLYMER HYDRATION APPARATUS AND METHODS OF USE

CROSS REFERENCE TO RELATED APPLICATIONS

This application is a divisional application of patent application Ser. No. 11/246,969, filed Oct. 7, 2005, issued as U.S. Pat. No. 7,794,135 on Sep. 14, 2010, and claims the benefit of the filing date thereof, the disclosure of which is hereby incorporated by reference in its entirety.

This patent application is a non-provisional application of provisional application Ser. No. 60/625,546 filed Nov. 5, 2004.

BACKGROUND OF THE INVENTION

1. Field of the Invention

The present invention relates to the preparation of subterranean formation treatment fluids, and more particularly, but not by way of limitation, apparatus and methods for preparing viscous treatment gels with dry polymer and water.

2. Description of the Related Art

In the oil drilling and production industry, viscous aqueous fluids are commonly used in treating subterranean wells, and as carrier fluids. Such fluids may be used as fracturing fluids, acidizing fluids, and high-density completion fluids. In an operation known as well fracturing, such fluids are used to initiate and propagate underground fractures for increasing oilwell productivity.

Viscous fluids, such as gels, are typically an aqueous solution of a polymer material. A common continuous method used to prepare viscous fluids at an oilwell site, involves the use of initial slurry of the polymer material in a hydrocarbon carrier fluid (i.e. diesel fluid) which facilitates the polymer dispersion and slurry mixing. Although this process achieves the required gel quality, the presence of hydrocarbon fluids is often objected to in particular fields, even though the hydrocarbon represents a relatively small amount of the total fracturing gel once mixed with water. Also, there are environmental problems associated with the clean-up and disposal of both hydrocarbon-based concentrates and well treatment gels containing hydrocarbons; as well as with the clean-up of the tanks, piping, and other handling equipment which have been contaminated by the hydrocarbon-based gel.

Other applications used for the continuous mixing of viscous treatment gels include gelling the polymer in a hydrocarbon carrier that is mixed with water to produce the fracturing gel which is then flowed through baffled tanks providing first-in/first-out (FIFO) flow pattern, and allowing for the hydration time of the gel. Yet, another technique for mixing of dry polymer directly to produce viscous treatment gels is described in Allen, U.S. Pat. No. 5,426,137, Allen, U.S. Pat. No. 5,382,411, and Harms et al., U.S. Pat. No. 5,190,374. These techniques, while potentially effective, require several complicated steps to prepare the gel, which presents drawbacks in an oilwell setting. Further, U.S. Patent Application 2004/0256106 A1 discloses an apparatus without an eductor, for substantially hydrating a gel particulate using a mixer in conjunction with an impeller located within the mixer housing, which prevents formation of gel balls.

Therefore, there is a need for apparatus and methods useful for hydrating a dry polymer constituents directly for preparing viscous treatment gels in a continuous mode without the use of the hydrocarbon carrier fluid, and such need is met, at least in part, by the following invention.

SUMMARY OF THE INVENTION

Preparation of a viscous treatment gel from dry polymer is achieved by first dispersing the polymer in water utilizing a constant volume commercial eductor. A premixing device may also be placed in parallel with the eductor to help dispersion and reduce air introduction into the mixture. The eductor operates at a constant water rate and pressure thus producing a concentrated polymer slurry. The resulting concentrated polymer slurry is discharged into a specifically designed dilution and remixing chamber, referred to herein as a "mixing chimney." In the input section of the mixing chimney, a jet of metered dilution water is applied at high pressure to the incoming concentrated polymer slurry stream, to form a diluted polymer slurry. The dilution stream accelerates the concentrated polymer slurry in a circular, and preferably upward, motion where it is sheared against the high drag wall of the chimney, thus fully mixing both streams producing a homogenous diluted gel. The diluted polymer slurry is further sheared as it exits the mixing chimney through circumferentially located perforations or slots which are located upon the output section of the mixing chimney. The exiting viscous treatment gel may then be contained by an external splash-guard, or outer chamber, that arrests the radial velocity of the exiting gel while maintaining some of the rotational motion of the fluid into a storage compartment of a hydration tank. The above apparatus provides a simple to operate and robust field technique for continuously producing quality viscous treatment gel at any rate, as required by any specific oilwell application.

The present invention may be used for continuously mixing and dispersing quality gel from polymer powder, without the need for pretreating the polymer with or spraying by chemicals that function, for instance, as pH buffers or even hydration retarders. Hence, the invention enables effective use of untreated polymers to prepare a viscous treatment gel at a wellsite.

DETAILED DESCRIPTION OF THE PREFERRED EMBODIMENTS

Figure 1:
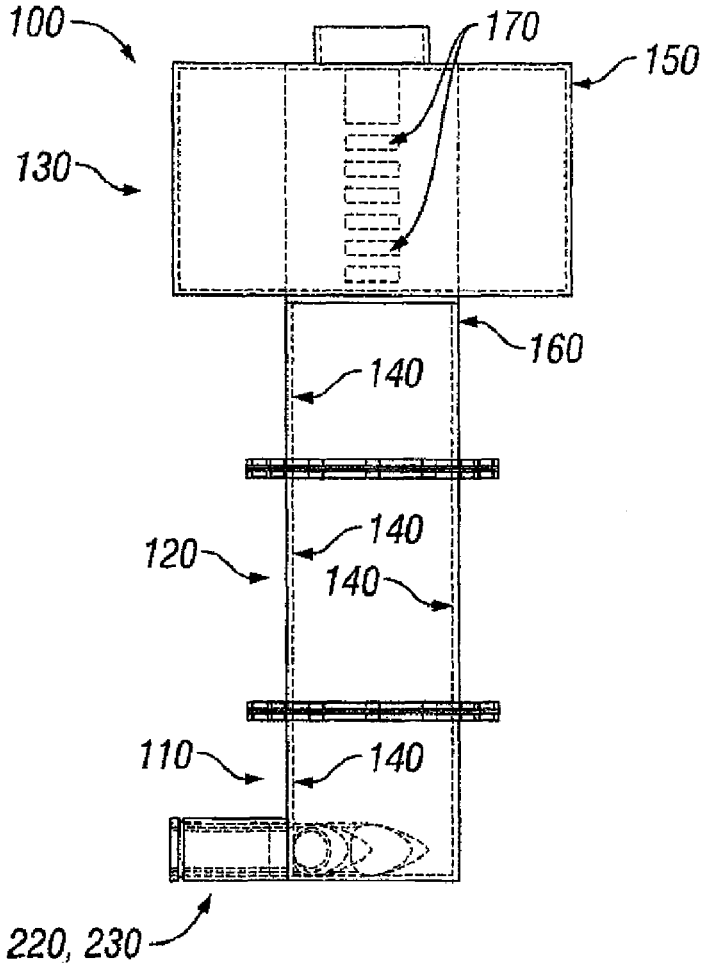
FIG. 1 shows a general overview of an embodiment of a mixing chimney according to the invention.

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time consuming, but would nevertheless be a routine undertaking for those of ordinary skill in the art having the benefit of this disclosure. Preferred embodiments of the invention will now be described with reference to the drawings, wherein like reference characters refer to like or corresponding parts throughout the drawings and description.

The present invention relates to the preparation of subterranean formation treatment fluids, and more particularly, but not by way of limitation, an apparatus and methods for preparing a viscous treatment gel from dry polymer constituents and water in a continuous mode. The apparatus and methods are particularly useful for preparing a viscous treatment gel from dry polymer at a wellbore site for fracturing a subterranean formation. As used herein: the term "gel" means any liquid material in a viscous state suitable for treating a wellbore; "dry polymer" means any form of polymer which is commercially available, transferred, or supplied, in a solid form (crystalline, amorphous, or otherwise), and not in an aqueous or non-aqueous solvated, slurried, or suspended form, and may be any polymer type useful for well treatments, including, but not limited to biopolymers such as xanthan and diutan, cellulose and its derivatives (i.e. carboxymethylhydroxyethyl cellulose, hydroxypropyl cellulose, etc.), guar and its derivatives (i.e. carboxymethylhydroxypropyl guar, hydroxypropyl guar, carboxymethyl guar, carboxymethylhydroxyethyl guar, etc.), polylactic acid, polyglycolic acid, polyvinyl alcohol, polyacrylamide, other synthetic polymers, and the like. Any dry polymer may contain commercially acceptable moisture levels.

Referring to FIG. 1, in one embodiment of the invention, the apparatus generally is a mixing chimney (housing) 100 without the need for an impeller inside the chimney, that serves to dilute and mix a concentrated polymer slurry. The mixing chimney 100 also assists in removing air from (de-aerates) the mixture. The mixing chimney 100 comprises a lower input section 110 wherein concentrated polymer slurry and water are separately introduced under pressure, a central section 120 through which the slurry and water are mixed and sheared, and a top section 130 wherein the mixture is further sheared as well as exits. To enable adequate mixing and shear, along the inner wall of mixing chimney 100, mechanical structures 140 may be disposed thereon in order to impart mixing friction and increase mixing surface area. Suitable examples of the mechanical structures include, but are not necessarily limited to, metallic protrusions, expanded metal mesh, and the like.

Figure 2A:
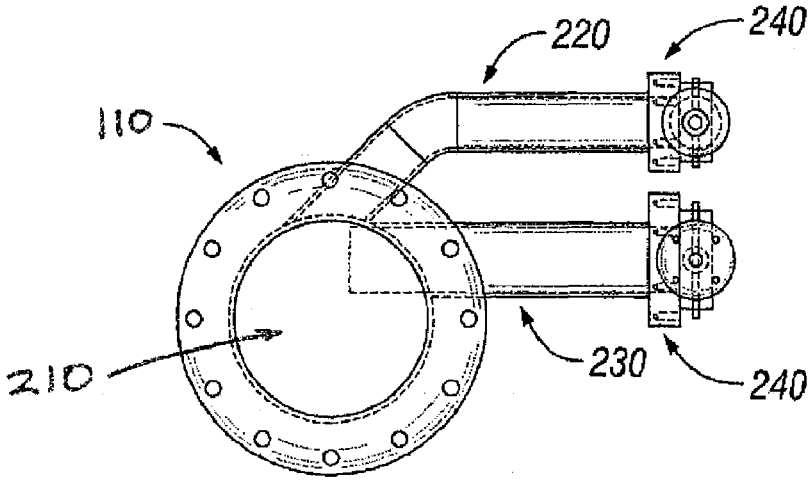
FIG. 2A is a top cross-sectional illustration representing an input section of a mixing chimney embodiment according to the invention.
Figure 2B:
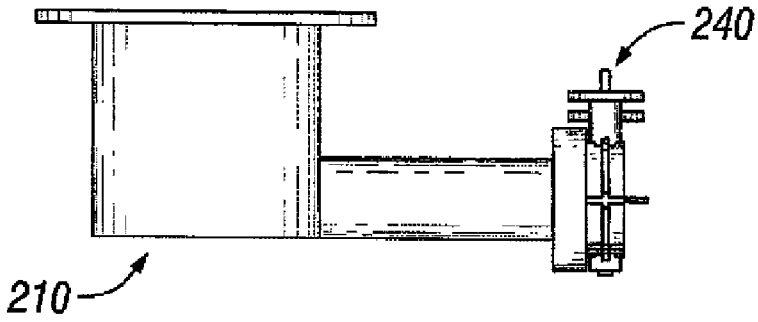
FIG. 2B is a first side view of an input section of a mixing chimney embodiment according to the invention.
Figure 2C:
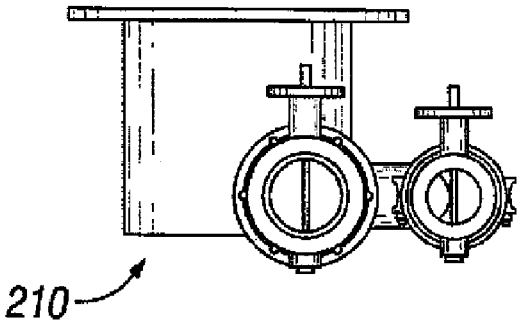
FIG. 2C is a second side view of an input section of a mixing chimney embodiment according to the invention.

Referring to FIGS. 2A-2C, top and side representations of lower input section 110 of a mixing chimney 100 according to an embodiment of the invention, the lower input section 110 has a mixing and dilution chamber 210, and is ported with inlets in such way as to connect to input tubes 220, 230. Input tubes 220 and 230 facilitate the transport of dilution water and concentrated polymer slurry into the mixing chimney 100. Input tube 230 includes a butterfly type valve 240 placed directly at the entrance of the mixing and dilution chamber to control the dilution rate and produce a high velocity water jet across the range of desired flow rates. The concentrated polymer slurry is initially prepared by forming a dispersion of dry polymer in water in an eductor. The concentrated polymer slurry is supplied from the eductor through input tube 220.

In an embodiment of the present invention, input tube 230 is used to inject dilution water for mixture with the concentrated polymer slurry. The water stream is injected tangentially under pressure along the inner wall of the lower input section 110 of the mixing chimney 100. Along the inner wall of the lower input section 110, the water sweeps and accelerates the concentrated polymer slurry stream into a circular motion as the slurry is injected through input tube 220. The unrestricted flow path in the vertical upwards direction in the mixing chimney 100 allows the incoming slurry and dilution water to move upwards with the resultant flow of the diluted mixture being spirally upwards along the inner wall of the chimney 100. The rotating motion and the upwards flow induced by the motive force of the dilution water stream from input tube 230, and not merely the passive energy of the slurry stream from input tube 220, aids in the elimination of air from the mixture.

Figure 3:
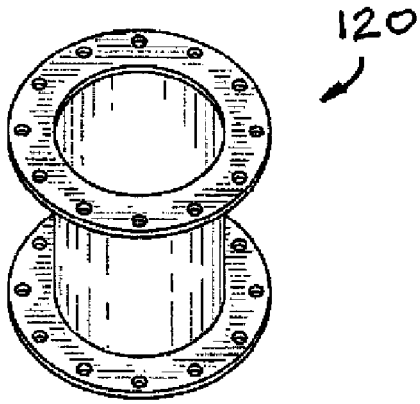
FIG. 3 shows an isometric illustration of a mixing chimney middle section according to an embodiment of the present invention.

FIG. 3, is an isometric illustration of a mixing chimney central section 120 according to an embodiment of the present invention. The central section 120 of the mixing chimney, illustrated in FIG. 1, which is positioned adjacent the input section 110. As described above, to enable adequate mixing and shear, mechanical structures 140 may be disposed about the inner wall of the central section 110 to provide higher shear energy. The inner wall may also be smooth. The velocity of the fluid mixture induced by the concentrated polymer slurry and water input streams, as well as the high centrifugal force from the rotation produce a high level of shear against the wall of the central section to effectively homogenize the mixture and further disperse the polymer. This effectively prevents the formation of undesirable gel balls (commonly referred to as fish-eyes).

Referring again to FIG. 1, in this embodiment, the diluted polymer slurry then passes from the central section 120 upwards into the top section 130. The top section 130 has a hollow cylindrical outer chamber 150 which surrounds upper chamber 160, at least in part. The upper chamber 160 of the top section 130, wherein the diluted polymer slurry transports to from the central section 120, may have mechanical structures 140 disposed about the inner wall. The diluted polymer slurry then passes from upper chamber 160 and into outer chamber 150. As the diluted polymer slurry passes from upper chamber 160 and into the space within outer chamber 150, the slurry passes through a plurality holes or slots 170 circumferentially located upon the periphery of the chamber 160 which may further shear the diluted polymer slurry as it exits the chamber 160. As the diluted polymer slurry exits the mixing chimney 100, it is considered formed into a gel which is essentially fully mixed and de-aerated, and at least partially hydrated.

Upon exiting the mixing chimney 100, the gel may pass into a first compartment of the hydration tank. In one process, the treatment gel is delivered on a first-in/first-out flow path of the hydration tank, as the treatment gel exits the chimney. Such processes are known in the art and or generally described in Constien et al., U.S. Pat. No. 4,828,034, and McIntire, U.S. Pat. No. 5,046,865, herein incorporated by reference thereto.

In one embodiment the mixing chimney 100 comprises a lower input section 110 a central section 120, and a top section 130 wherein each section is connected to form a chamber for mixing. The sections may be connected by any means know in the art, such as, by non-limiting example, welding or connectable flanges. In other embodiments of the present invention, the chamber may also be formed from one or two cylinders.

Some mixing chimneys according to the invention may have the input section placed other than the lower portion. For instance, the input section may be at the top of the chimney, while the section through which the diluted polymer slurry exits is positioned at the bottom of the chimney. Hence, the chimney could be comprised of: a top input section comprising a mixing and dilution chamber and inlets connected to input tubes; a central section wherein polymer slurry and water are mixed and sheared; and, a bottom section comprising a plurality holes circumferentially located upon the periphery thereof through which gel exits the chimney.

In another embodiment of the invention, a method for hydrating a dry polymer to prepare a viscous treatment gel is provided. The process generally includes the steps of dispersing dry polymer in water in an eductor to form a concentrated polymer slurry, and simultaneously injecting the concentrated polymer slurry with water into the input portion of the mixing chimney. The concentrated polymer slurry and dilution water are mixed inside the mixing chimney to form a diluted polymer slurry. The diluted polymer slurry exits through plurality holes or slots positioned at the output section of the mixing chimney to provide a viscous treatment gel. The viscous treatment gel may then be contained and delivered from a hydration tank.

In further embodiments of the invention, the viscous treatment gel may also be held and flowed through vertically baffled compartments of a first-in/first-out hydration tank which ensures residence time to accommodate further, or full hydration of the gel. Bar turbine agitators in each of the compartments may be further used to shear the gel enhancing the hydration process, and improving the first-in/first-out flow pattern. The fluid is discharged by gravity from the last compartment of the hydration tank. Process control with feedback from level sensors in each compartment, or the last compartment, controls the mixing rate by altering the opening of the dilution valve.

Figure 4:
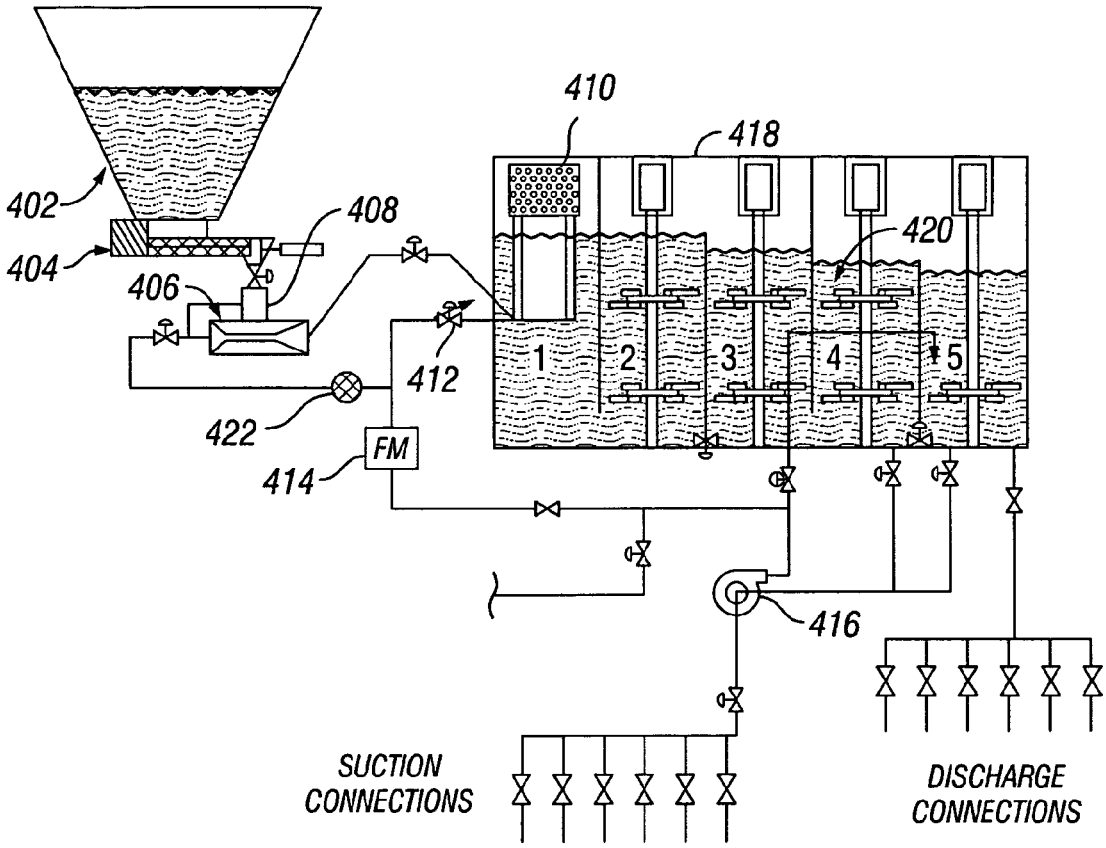
FIG. 4 illustrates a process scheme and apparatus that provides the means for continuous mixing and hydration of well viscous treatment gels from dry polymer.

FIG. 4 illustrates another embodiment of the invention, which is a method and apparatus that provides the means for continuous mixing and hydration of well viscous treatment gels from dry polymer at a wellbore site. This process and apparatus may however be used for mixing other types of powder material with liquids as well.

FIG. 4 shows the general process scheme which includes a centrifugal pump 416 that produces motive energy, a mixing eductor 406 that disperses the dry polymer forming a concentrated polymer slurry, a feeder 404 for dispensing the dry polymer from storage/supply bin 402 into the mixing eductor 406, a dilution and mixing chamber (chimney) 410 that receives the concentrated polymer slurry, mixes with dilution water, and discharges a diluted polymer slurry with the required polymer concentration into tank 418. Tank 418 is a multi compartment, 1, 2, 3, 4, 5, first-in/first-out holding and hydration tank equipped with shearing agitators 420. Tank 418 stores and further hydrates the diluted polymer slurry to form a viscous treatment gel.

In the embodiment represented by FIG. 4, the dry polymer is stored in a storage bin 402 attached to a volumetric feeder 404. The feeder 404 discharges the dry polymer into a mixing eductor 406, where it is dispersed in water, provided from a supply of water, to form a slurry. The supply of water may be introduced into the system via suction connections attached to any suitable available water source. The bin 402 and the feeder 404 are mounted on load cell that continuously records the weight of the bin 402. Metering of the polymer load rate may be achieved by an initial approximate volumetric rate given by the metering the volumetric feeder 404 screw speed. Accurate gravimetric proportioning is achieved by continuously monitoring the loss in weight of the storage bin 402. Either of these two metering methods may be used individually or in combination. A radial premixer 408, for premixing dry polymer in an aqueous medium, may optionally be placed between the feeder 404 and mixing eductor 406.

Referring again the FIG. 4, and the embodiment represented thereby, the mixer is a fixed nozzle size eductor 406 which flows a fixed volume of fluid when operated at a constant pressure. The eductor 406 disperses the dry polymer in water and produces a concentrated polymer slurry at a constant flow rate. The resulting concentrated polymer slurry is directed to mixing chimney 410 where the dilution water jet sweeps the concentrated stream and accelerates it into a circular upwards-spiraling motion. The resulting diluted polymer slurry is sheared against the inner wall of the central section of mixing chimney 410 as well as when it exists from top of mixing chimney 410 through the circumferentially located holes or slots to complete the mixing and prevent formation of gel balls. Dilution stream is controlled by a butterfly type valve equipped with an automatic controller 412 which sets the valve position to achieve the required mixing rate. The butterfly valve is located directly at the entry of the chimney and is oriented in a way to produce a jet with a tangential flow into the chimney. A flow meter 414 upstream of both eductor and dilution flow measures the total rate and sends a signal to the controller for setting the position of the control valve. The speed of the feeder 404 is set by the controller to maintain the required ratio between the volume of the mixing water as measured by the flowmeter 414 and the amount of dry polymer dispensed by the storage bin 402. As mixing water moves from flowmeter 414 to eductor 406, the water may optionally pass through a filter 422 to trap any undesirable particles.

The amount of dry polymer dispensed from bin 402 may be determined by any suitable means, including gravimetrically by measuring the loss in mass of the bin 402, or volumetrically by controlling the speed of the metering screw 404. To further formation of the viscous treatment gel, diluted polymer slurry exits the mixing chimney 410 into the first compartment of the hydration tank 418. Then it may be directed from one compartment to the next flowing downwards from the first compartment 1 to the second 2, upwards from the second 2 to the third 3, downwards from the third 3 to the fourth 4, and upwards from the fourth 4 to the fifth 5. This maintains a predominantly first-in/first-out flow pattern and ensuring the gel spends at least the required residence time at maximum rate to complete its hydration. Agitators 420 (only one indicated) in each of the compartments may be used to add energy and enhance hydration, as well as to maintain the first-in/first-out flow pattern by minimizing channeling. Ultimately, the viscous treatment gel is supply to a wellbore from the hydration tank via discharge connections.

The following example illustrates the operation of an embodiment of the invention. The target output rate of a wellbore viscous treatment gel for at a wellbore site is about 20 barrels per minute (840 gal per min., 3180 liters per minute), and the desired concentration of dry polymer in the treatment gel is 40 lb/1000 gallons (4.8 kg/1000 liters). Referring again to FIG. 4, to achieve this rate, chimney 410 would deliver 20 barrels/min (840 gal/min, 3180 liters/min) of diluted polymer slurry to hydration tank 418. If eductor 406 has a fixed output of 160 gal/min (606 liters/min) to supply concentrated polymer slurry stream to chimney 410, then the dilution stream water supply rate to chimney 410 will be 680 gal/min (2574 liters/min). In order to provide the dry polymer concentration (40 lb/1000 gallons) at a viscous treatment gel output rate (20 barrels per minute), 33.6 lb/min (15.3 kg/min) of dry polymer should be supplied from bin 402 to eductor 406, and mixed with water supplied thereto to form a concentrated slurry with dry polymer concentration of about 210 lb/1000 gallons (25.2 kg/1000 liters).

Also, in other embodiments of the invention, a method and apparatus that provides the means for continuous mixing and hydration of well viscous treatment gels from dry polymer may incorporate the use of a plurality of mixing chimneys. The mixing chimneys may be connected in series, parallel, or any combination thereof.

While presently preferred embodiments of the invention have been described herein for the purpose of disclosure, numerous changes in the construction and arrangement of parts and the performance of steps will suggest themselves to those skilled in the art in view of the disclosure contained herein, which changes are encompassed within the spirit of this invention, as defined by the following claims.

We claim:

1. A method for preparing a viscous treatment gel comprising the steps of:

(a) dispersing dry polymer in water in an eductor to form a concentrated polymer slurry;

(b) simultaneously injecting the concentrated polymer slurry stream and dilution water steam into the input section of a mixing chimney;

(c) mixing the concentrated polymer slurry stream and water steam inside the mixing chimney to form a diluted polymer slurry; and (d) passing the diluted polymer slurry through a plurality of slots positioned upon the periphery of the output section of the mixing chimney to provide a viscous treatment gel, and wherein the mixing further comprises directing the polymer slurry stream and water stream in a vertically upward direction in the mixing chimney.

2. The method according to claim 1 further comprising supplying dry polymer from a bin, and metering the polymer supply rate to the eductor using a gravimetric load, a volumetric feeder, or combination of both.

3. The method according to claim 1 further comprising a bin and volumetric feeder for discharging the dry polymer into said eductor.

4. The method according to claim 1 further comprising a centrifugal pump to produce the motive energy.

5. The method according to claim 1 further comprising butterfly valves positioned in such way as to control the input rate of both water and concentrated polymer slurry dilution streams into the mixing chimney.

6. The method according to claim 1 further comprising compartments that are in fluid connection with the mixing chimney for further hydrating and delivering the treatment gel in a first-in/first-out process.

* * * * *